United States Patent [19]

Robillard et al.

[11] 4,361,108

[45] Nov. 30, 1982

[54] IMAGE-TRANSFERRING SHEET

[76] Inventors: Jean J. Robillard, 358 N. Pleasant St., Amherst, Mass. 01002; John D. Angleman, 265 E. 66th, Apt. 15-D, New York, N.Y. 10021

[21] Appl. No.: 234,208

[22] Filed: Feb. 13, 1981

[51] Int. Cl.[3] ..... B05C 11/00; B41M 5/16

[52] U.S. Cl. ..... 118/265; 118/264; 282/27.5; 401/196; 427/150; 427/151; 427/152; 427/385.5; 427/391; 427/395; 428/212; 428/218; 428/320.4; 428/537; 428/914

[58] Field of Search ..... 282/27.5; 427/150, 151, 427/152, 153, 372.2, 384, 385.5, 391, 395; 428/307, 537, 914, 212, 218, 320.2, 320.4, 320.6, 320.8, 511, 514, 522; 118/264, 265; 162/162; 400/204; 401/52, 196

[56] References Cited

FOREIGN PATENT DOCUMENTS 941549 11/1963 United Kingdom ..... 282/27.5

1242740 8/1971 United Kingdom ..... 282/27.5

*Primary Examiner*—Bruce H. Hess

*Attorney, Agent, or Firm*—Sherman & Shalloway

[57] ABSTRACT

This invention provides an image-forming and image-transferring sheet comprising a base layer having a first surface and a second surface. The base layer is impregnated with a first image-forming reactant whereas each of the surfaces of the base layer has coated thereon a microporous membrane layer having a gradient in elasticity across the thickness thereof. The more elastic surface of the membrane is in contact with the base layer. The other surface of the membrane is coated with a second image-forming reactant. Upon impact by an image instrument such as a typewriter key, the membrane becomes extended to allow diffusion of the first reactant through the membrane to react with the second image-forming reactant on the surface of an adjacent sheet to form an image on the surface of the adjacent sheet. A method of preparing an image-forming and image-transferring sheet is also provided.

7 Claims, 5 Drawing Figures

IMAGE-TRANSFERRING SHEET

BACKGROUND OF THE INVENTION

The present invention relates to image-transfer sheets for multiple-record service. More particularly, this invention relates to image-transfer papers for use in sets which are capable of transferring images upon impact on that surface of each paper which faces the impacting instrument so that differing records may be entered on opposite sides of manifold sets formed from image transfer sheets of this invention without backprinting on the other surface of the paper, i.e., that surface which faces away from the impact instrument.

A variety of attempts have been made in the development of "non-carbon" papers for use in manifold sets which are secured at one edge to avoid the need for assembly of such sets by the user, and to avoid the problem of smudging or smearing which is typical of carbon-type transfer sheets.

A particularly effective image transfer paper is typicafied in a series of patents to Barrett K. Green, including U.S. Pat. Nos. 2,548,366; 2,550,466; 2,550,467 and 2,618,573. Typically, these papers are mutually sensitized by the presence of image-forming reactants on adjacent sheet surfaces, at least one of the reagents being micro-encapsulated to avoid unintentional reaction between the reagents. The pressure or pinching of local areas of the papers, such as by a typewriter key and platen, is relied upon to rupture and free the micro-encapsulated reagent in the impact area, thereby causing the desired image transfer to the subjacent sheet. These non-carbon papers have proven generally satisfactory and have enjoyed commercial success, both in the simpler two-sheet sets and in manifolds in which several imaged copies are desired.

However, the non-carbon papers heretofore available have been limited to the application of images to only one side of the sheet or form, since the transfer of the imaging reactants has not been directionally controllable and, therefore, results in backprinting on the "back" of the sheet from the surface on which the image is desired, if used on the "wrong" side.

This backprinting will confuse or make illegible a subsequently desired image on the back surface, consequently precluding the use of both sides of the assembled papers. Therefore, these papers have made necessary the use of excessive numbers of sheets and have resulted in considerable costs not only for the papers themselves but also for the filing or storage of such one-side-only records.

U.S. Pat. No. 3,968,299 discloses a directional, image-transfer paper having multiple reagents for image reproduction and screening means for selectively releasing one of the reagents only in the direction of impact of the image-producing implement, e.g., a pen or typewriter key. However, to form the patented paper, it is necessary to form on a paper base the screening means, a cumbersome process.

Therefore, the prior non-carbon sheets or papers have not been found to be entirely satisfactory.

SUMMARY OF THE INVENTION

The present invention provides a selective directional image-forming and image-transferring sheet comprising a laminate of a support layer interposed between two membranes. Each membrane has a gradient in cross-linking extending from one surface to the other. As a result of this gradient, the flow of a first image-forming reactant contained in the support layer towards the outer surface of the membrane is permitted only when the membrane is in an extended state, e.g., when impacted by an image-forming implement such as a pen or typewriter key. The first reactant flows through the pores and wets the surface of the membrane on an adjacent image transfer paper placed behind the first image transfer paper. Consequently, the first image-forming reactant reacts with the second image-forming reactant deposited on the surface of the second sheet to produce an image on the surface of the second sheet without the formation of such image on the back surface of the first sheet.

DETAILED DESCRIPTION OF THE INVENTION

Figure 1:
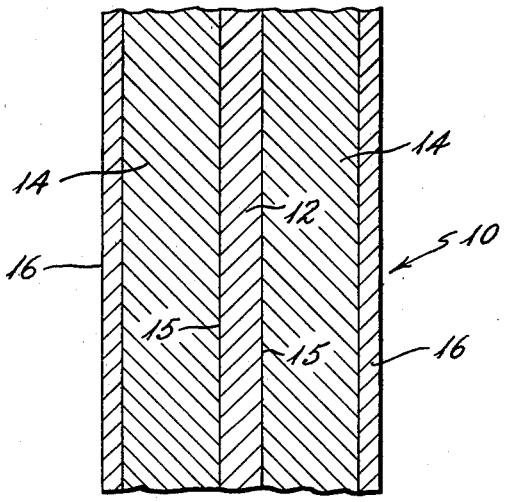
FIG. 1 illustrates a cross-sectional view of the present image-forming and image-transferring sheet.

According to the present invention, the selective directional image transfer sheet 10 comprises the laminate structure shown in FIG. 1. The laminate comprises a base or support layer 12 which is interposed between two microporous membrane layers 14. A useful example of the base layer is paper. An image-forming reactant (hereinafter, first image-forming reactant) is dispersed in the support layer 12. Alternatively, the first image-forming reactant is deposited on both surfaces of the base layer in the form of a coating. The surface 16 of the membrane which is not in contact with the paper is coated with a compound which can react with another compound to form a color image (hereinafter, second image-forming reactant).

The construction of membrane 14 is of particular significance and is presented in further detail as follows.

Figure 2:
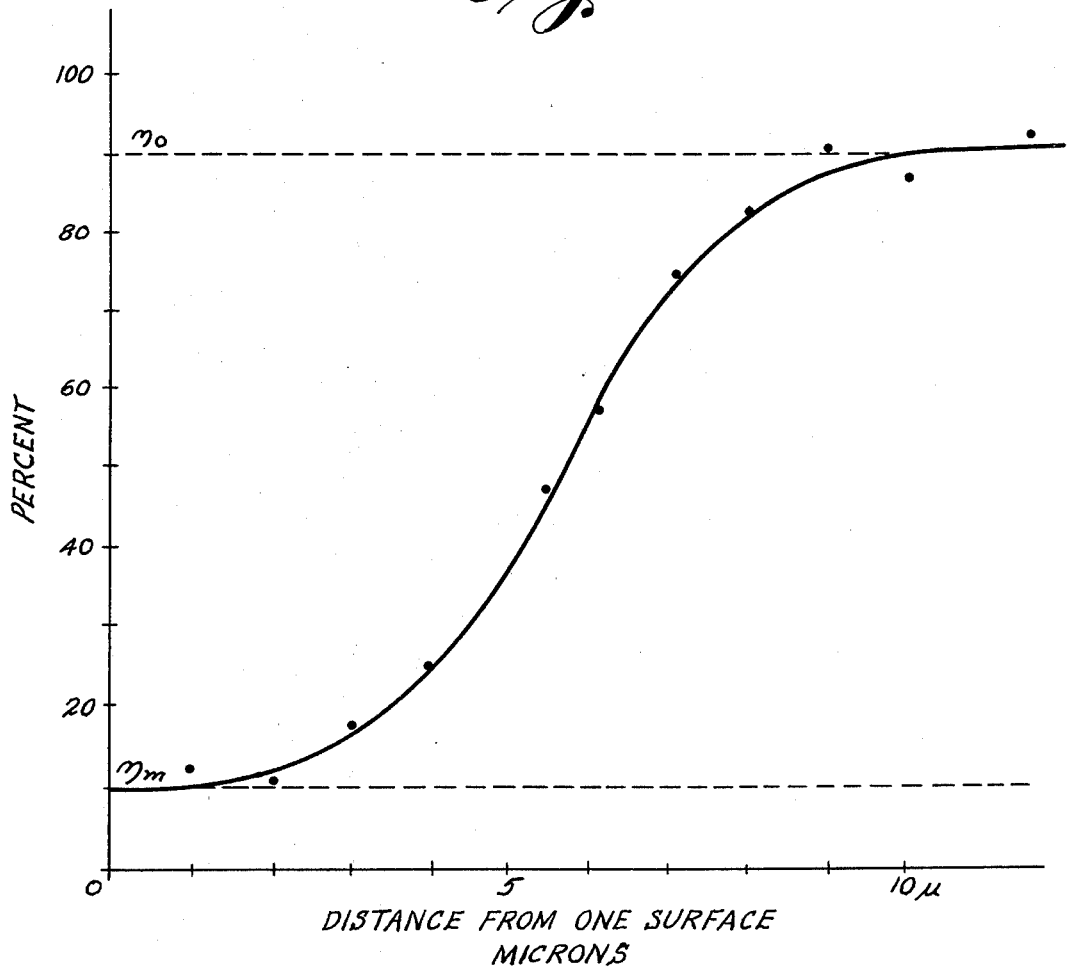
FIG. 2 shows the relationship between cross-linking in the microporous membrane as a function of distance from one surface of the membrane.

Membrane 14, which has two surfaces, 15 and 16, is made of a cross-linked copolymer in which the degree of cross-linking varies from one surface of the membrane to the other. The relationship of the degree of cross-linking as a function of the distance from one surface of the membrane is illustrated in FIG. 2. As a result of this variation in cross-linking, a gradient of elasticity is provided in the membrane. That is to say, one surface of the membrane is more elastic than the other due to the variation in cross-linking. In forming the present image-transfer paper, the more elastic surface 15 of membrane layer 14 is placed in contact with base paper 12. As is mentioned, surface 16 of the membrane is coated with the second image-forming reactant.

Figure 3:
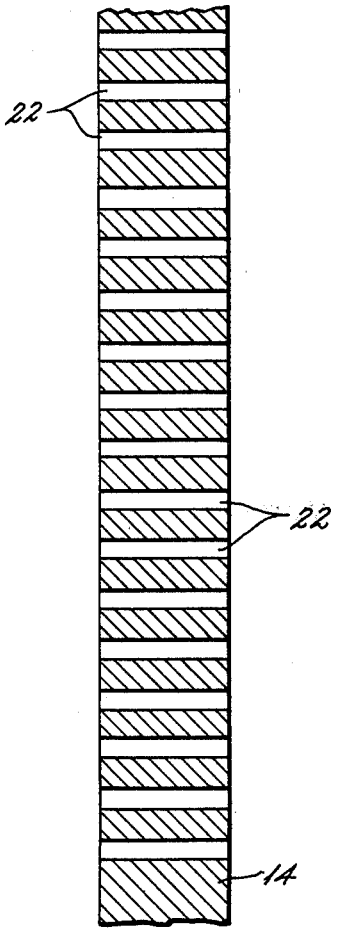
FIG. 3 shows a cross-sectional view of the microporous membrane in its relaxed state.
Figure 4:
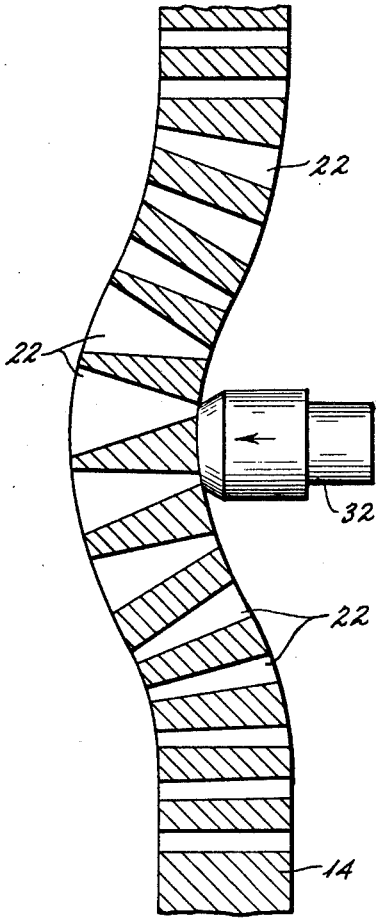
FIG. 4 shows a cross-sectional view of the microporous membrane in its extended state.

The micropores in the membrane are caused to be open or closed to the flow of a chemical reagent depending on whether the membrane is in a relaxed or extended state. FIGS. 3 and 4 illustrate cross-sectional views of the microporous membrane in its relaxed and extended states, respectively.

In its relaxed state, liquid is prevented from flowing out of the micropores 22 as a result of capillary forces. However, when the membrane is caused to be extended (FIG. 4), for example, due to impact by a pen or typewriting key 32, the pores are forced to open and take the shape of a cone so that the chemical reactants can flow out of the membrane in the direction of the arrow in FIG. 4.

The conical shape of the pores is important in that it permits control of the flow of the reactants, thereby avoiding marking on the membrane surface. This shape of the pores in the extended membrane results from the gradient of elasticity provided by the variable cross-linking across the thickness of the membrane. Such a variable cross-linking is produced by a variation in concentration during the polymerization process.

The following is a proposed mechanism for the present image-transfer process. However, the present inventors propose such a mechanism merely for the purpose of explanation and do not wish to be bound thereby.

Figure 5:
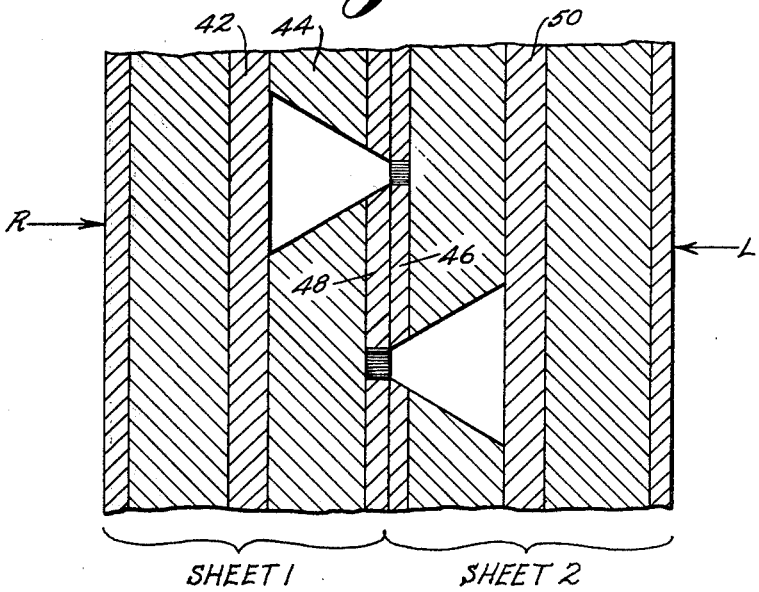
FIG. 5 shows the formation of images on the present image-forming and image-transferring sheets.

When in use, two or more sheets of the present image-transfer sheet are placed one over the other. As illustrated in FIG. 5, which represents an enlarged section of two sheets, sheet 1 and sheet 2 are in contact with each other. Pressure is exerted on the left side of sheet 1 in the direction R causing the first image-forming reactant in base layer 42 to diffuse through membrane 44, wet and react with the second image-forming reactant provided in surface coating 46 of sheet 2, thus forming an image on the surface of sheet 2. The wetting of the surface coating of sheet 2 is significant in that it prevents the first image-forming reactant in membrane 44 from reacting with the second image-forming reactant coated on the surface of membrane 44 so that there is no "back-printing." On the other hand, when an impact is struck on the sheet in the L direction in FIG. 5, the first reactant in base layer 50 is caused to diffuse in the direction L to form an image on the surface of coating 48 of sheet 1. It should be noted that the cones shown in FIG. 5 are for showing the gradient in elasticity, with the surface in direct contact with the base layer being more elastic. In other words, the cones in FIG. 5 do not represent micropores.

As noted above, the conical shape of the micropores resulting from impact prevents the formation of the image on the "back-side" of sheet 1. Instead, the reactant in the top sheet is caused to wet the surface of the bottom sheet to form an image. Thus, back-printing is eliminated from the present image transfer sheet.

The microporous membranes can be formed first and then laminated onto the base layer. Alternatively, a composition for forming the membrane is coated on the base layer and then polymerized to produce the membrane.

The microporous membrane is obtained by decreasing the solubility of the material forming the membrane during the polymerization process. Materials used in the preparation of such membranes result from the combination of monomers having one double bond in bi-functional or polyfunctional methacrylates which may be obtained by esterifying methacrylic acid with polyhydroxylic alcohols such as glycols or compounds having more than two hydroxyl groups.

The polyhydroxylic alcohol for this purpose has to possess further hydrophilic groups, making the compound water soluble even when two or more hydrophilic groups are esterified by methacrylic acid. The starting materials include mono- and bi-functional monomers with ionizable and non-ionizable hydrophilic groups. Listed below are some materials pertaining to these categories:

A. Monofunctional ionizable hydrophilic groups: Cationic: dimethylaminoethylmethacrylate, piperidinoethylmethacrylate, morpholinoethylmethacrylate, B. Monofunctional non-ionizable hydrophilic groups: Monofunctional non-ionizables: monomethacrylate of glycols, glycerol and other polyhydroxylic compounds, monomethacrylates of di- and poly-alkylene glycol.

The first reactant impregnated in the base layer generally comprises a dye promotor such as a leuco dye in its oxidized state. It can be introduced in the base layer during its manufacturing at the paper mill or it can be dispersed in a separate layer coated on the base paper. The first alternative is certainly preferable from an economical point of view.

Examples of the first image-forming reactant are:
crystal violet lactone, thionine, rhodamine B lactone, 3-diethylamino-7-dibenzylamine-5-methylfluoran, 3-diethylamino-6-methyl-7-chlorofluoran.

Examples of the second image-forming reactant (i.e., that in the surface coating of the membrane) are:
bentonite, aluminum sulfate, bisphenol A, methylene 2,2 bis(t-Bu-6 Me-4-phenol).

The present invention is further illustrated in the following non-limiting Examples.

EXAMPLE I

Preparation of an image-transfer sheet with the first image-forming material in the base layer (a) A 3% solution of crystal violet lactone in toluene is prepared.

(b) A solution comprising 25 g gelatine, 25 g gum arabic, and 300 g water is prepared.

(c) The solutions of (a) and (b) are mixed under vigorous stirring at 75° C.

(d) Add the solution of (c) to 100 g of $H_2O$ and acetic acid until the pH reaches 4.2.

(e) The solution of (d) is cooled to 20° C. and 25% formaldehyde is added.

(f) A base paper having the following composition for 10 kg (pulp) is formed with a handsheet machine:

| | |
|---|---|
| Hardwood Kraft pulp | 24.2 g |
| Softwood Kraft pulp | 56.5 g |
| Clay | 8.26 g |
| Talc | 3.22 g |
| Rosin | 0.4 g |
| Aluminum sulfate (Alum) | 1.22 g |
| Cationic starch | 0.4 g |
| Emulsion from step (e) | 530.8 g |
| $H_2O$ | 9,375.0 g |

(g) On the sheet of (f), the following membrane composition is coated with a coating weight of 5 g/meter$^2$.

| | |
|---|---|
| Triethyleneglycol dimethacrylate | 20 g |
| Methylmethacrylate | 10 g |
| Water | 70 g |
| Potassium persulfate | 0.1 g |

After coating, the layer is polymerized at 50° C.

(h) On top of the membrane (g), a coating of the second image-forming material is deposited, the coating having the following composition:

| | |
|---|---|
| Water | 200 g |
| Bentonite | 100 g |
| Styrene-Butadiene Latex | 30 g |

The coating is deposited at a weight of 8 g/meter$^2$.

(i) Steps (g) and (h) are repeated on the other side of the sheet to form the final product.

EXAMPLE II

Example I is repeated except solution (a) is replaced by a 4% solution of rhodamine B lactone in ethyl alcohol and solution (g) is replaced by 100 g of a 10% solution of polyvinyl alcohol in water.

EXAMPLE III

In this example, an image-transfer sheet of the present invention having the first image-forming reactant coated on the base layer is prepared as follows:

(a) A 3% solution of 3-dimethylamino 6 methyl 7-chlorofluoran in toluene is prepared.

(b) A solution comprising

| | |
|---|---|
| gelatin | 25 g |
| gum arabic | 25 g |
| $H_2O$ | 100 g |

is also prepared.

(c) 100 g of the solution (a) is mixed with solution (b) and emulsified at 75° C. by means of a high speed emulsifier.

(d) To the emulsion of (c), 100 g of water is added and the pH thereof is adjusted with acetic acid to 4.2.

(e) The emulsion is cooled to 20° C. after which 10 g of 25% solution of formaldehyde in water is added.

(f) The emulsion of (e) is coated on a base paper at a coating weight of 5 g/m$^2$.

(g) On top of coating (f), a composition having the following composition is deposited:

| | |
|---|---|
| Polyvinyl alcohol (88% hydrolyzed) | 10 g |
| Ethanol | 60 cc |
| $H_2O$ | 40 cc |
| Polyethyleneglycoldiacrylate | 10 g |
| Phenantrenequinone | 0.2 g |

Thereafter, the composition is polymerized at 50° C. to form a membrane layer.

(h) On the membrane layer, the following composition is deposited:

| | |
|---|---|
| Bisphenol A | 2 g |
| $H_2O$ | 200 g |
| Polyvinyl alcohol (10% solution in water) | 200 g |

The composition is coated onto the membrane and base layers at a weight of 8 g/meter.

(i) The other surface of the base paper is coated by repeating steps (a)–(h) to form the final product.

EXAMPLE IV

Example III is repeated except that in step (f), the following composition is used to form the membrane layer:

| | |
|---|---|
| N-methoxymethylpolyhexamethylene adipamide | 10 g |
| Tetramethylene dimethacrylate | 15 g |
| Benzoin methyl ether | 0.15 g |

EXAMPLE V

Example II is repeated except that a 3% solution of 3 diethylamino 7 dibenzylamino-5-methylfluoran is used in step (a).

Thus, there is provided an image-forming and image-transferring sheet which will form an image on a second sheet upon being impacted without backprinting. Thereis also provided a method of making the image-forming and image-transferring sheet.

What is claimed is:

1. An image-forming and image-transferring sheet comprising a base layer having a first surface and a second surface, the base layer being impregnated with a first image-forming reactant, each of the surfaces having coated thereon a microporous membrane layer, the membrane comprising a cross-linked copolymer in which the degree of cross-linking varies from one surface of the membrane to the other, the copolymer comprising the polymerization product of monomers having one double bond with polyfunctional methacrylates obtained by esterifying methacrylic acid with polyhydroxylic alcohols, to form a gradient in elasticity across the thickness thereof so that the more elastic surface of the membrane is in contact with the base layer, the other surface of the membrane being coated with a second image-forming reactant, the membrane upon impact by an imaging instrument becoming extended to allow diffusion of the first reactant through the membrane to react with the second image-forming reactant on the surface of an adjacent sheet to form an image on the surface of the adjacent sheet.

2. The image-forming and image-transferring sheet of claim 1 wherein the base layer is paper.

3. The image-forming and image-transferring sheet of claim 1 wherein the first image-forming reactant comprises a leuco dye in its oxidized state.

4. The image-forming and image-transferring sheet of claim 1 wherein the first image-forming reactant is selected from the group consisting of crystal violet lactone, thionine, rhodamine B lactone, 3 diethylamino-7-dibenzylamine-5-methylfluoran, 3 diethylamino-6-methyl-7-chlorofluoran.

5. The image-forming and image-transferring sheet of claim 1 wherein the second image-forming reactant is selected from the group consisting of bentonite, aluminum sulfate, Bisphenol A, and methylene 2,2 bis(t-butyl-6 methyl-4-phenol).

6. An image-forming and image-transferring sheet comprising a base layer having a first surface and a second surface, each of the surfaces having coated thereon a layer of a first image-forming reactant, each of the first image-forming reactant layers being coated with a microporous membrane layer, the membrane comprising a cross-linked copolymer in which the degree of cross-linking varies from one surface of the membrane to the other, the copolymer comprising the polymerization product of monomers having one double bond with polyfunctional methacrylates obtained by esterifying methacrylic acid with polyhydroxylic alcohols, to form a gradient in elasticity across the thickness thereof so that the more elastic surface of the membrane is in contact with the base layer, the other surface of the membrane being coated with a second image-forming reactant, the membrane upon impact by an imaging instrument becoming extended to allow diffusion of the first reactant through the membrane to react with the second image-forming reactant on the surface of an adjacent sheet to form an image on the surface of the adjacent sheet.

7. A process of forming an image-forming and image-transferring sheet comprising impregnating a base layer with a first image-forming reactant, coating both surfaces of the layer with a polymeric composition comprising monomers having one double bond and polyfunctional methacrylates obtained by esterifying methacrylic acid with polyhydroxylic alcohols and capable of forming a microporous membrane having a gradient in elasticity across the thickness of the membrane, the more elastic surface of the membrane being in contact with the base layer, polymerizing the composition so that the degree of cross-linking varies from one surface of the membrane to the other and coating the outer surfaces of the membrane with a second image-forming reactant, the first and second reactants being capable of reacting with each other to form an image.

* * * * *